US006300303B1

(12) United States Patent
Bauer et al.

(10) Patent No.: US 6,300,303 B1
(45) Date of Patent: Oct. 9, 2001

(54) PHYLLOSILICATE-CONTAINING DETERGENT AND CLEANER COMPONENT

(75) Inventors: Harald Bauer, Kerpen; Josef Holz; Günther Schimmel, both of Erftstadt, all of (DE)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 09/213,657

(22) Filed: Dec. 16, 1998

(30) Foreign Application Priority Data

Dec. 19, 1997 (DE) ..... 197 56 696

(51) Int. Cl.[7] ..... C11D 3/08

(52) U.S. Cl. ..... 510/466; 510/404; 510/477; 510/511

(58) Field of Search ..... 510/404, 466, 510/477, 511

(56) References Cited

U.S. PATENT DOCUMENTS

| | | | | |
|---|---|---|---|---|
| 4,664,839 | | 5/1987 | Rieck . | |
| 4,737,306 | | 4/1988 | Wichelhaus et al. . | |
| 4,820,439 | | 4/1989 | Rieck . | |
| 4,950,310 | | 8/1990 | Rieck et al. . | |
| 5,356,607 | | 10/1994 | Just . | |
| 5,567,404 | | 10/1996 | Lee et al. . | |
| 5,641,741 | * | 6/1997 | Emery et al. | 510/457 |
| 5,814,289 | | 9/1998 | Tapper et al. . | |
| 5,856,294 | * | 1/1999 | Emery | 510/456 |
| 5,858,957 | * | 1/1999 | Donoghue et al. | 510/445 |

FOREIGN PATENT DOCUMENTS

| | | |
|---|---|---|
| 2017958 | 12/1990 | (CA) . |
| 35 26 405 | 2/1987 | (DE) . |
| 37 42 043 | 6/1989 | (DE) . |
| 39 20 704 | 1/1991 | (DE) . |
| 40 09 618 | 10/1991 | (DE) . |
| 42 10 253 | 9/1993 | (DE) . |
| 43 29 064 | 3/1995 | (DE) . |
| 43 29 392 | 3/1995 | (DE) . |
| 43 29 394 | 3/1995 | (DE) . |
| 0164514 | 12/1985 | (EP) . |
| 0550048 | 7/1993 | (EP) . |
| 0630855 | 12/1994 | (EP) . |
| 58-217598 | 12/1983 | (JP) . |
| WO 90/13533 | 11/1990 | (WO) . |
| WO 91/08171 | 6/1991 | (WO) . |
| WO 96/01307 | 1/1996 | (WO) . |

OTHER PUBLICATIONS

EPO Search Report.
Derwent Patent Abstract For Japan Patent No. 4036398—XP002900418.
Derwent Patent Family Abstract For Japan Patent No. 9302393—XP002900419.
Claims From EP Patent No. 0 716 682.
Claims From EP Patent No. 0 544 670.
Derwent Patent Family Abstract For German Patent No. 43 29 392.
Derwent Patent Family Abstract for German Patent No. 43 29 064.
Derwent Patent Family Abstract for German Patent No. 43 29 394.
Derwent Patent Family Abstract for German Patent No. 39 20 704.
Derwent Patent Family Abstract for German Patent No. 40 09 618.
Derwent Patent Family Report and/or Abstracts.

* cited by examiner

*Primary Examiner*—Cynthia H. Kelly
*Assistant Examiner*—Dawn L. Garrett
(74) *Attorney, Agent, or Firm*—Susan S. Jackson; Scott E. Hanf

(57) ABSTRACT

The invention relates to a phyllosilicate-containing detergent and cleaner component which has a bulk density of less than 540 g/l, a mean particle diameter of more than 150 $\mu$m, a particle size fraction below 150 $\mu$m of less than 10%, a particle size fraction above 1180 $\mu$m of less than 5% and a flow factor of more than 15.

The invention also relates to the use of the abovementioned phyllosilicate-containing detergent and cleaner component for the preparation of detergent constituents.

13 Claims, No Drawings

PHYLLOSILICATE-CONTAINING DETERGENT AND CLEANER COMPONENT

FIELD OF THE INVENTION

The invention relates to a phyllosilicate-containing detergent and cleaner component, to its use for the preparation of detergent constituents, and to detergent constituents comprising the abovementioned phyllosilicate-containing detergent and cleaner component.

BACKGROUND OF THE INVENTION

Crystalline sheet sodium silicates (phyllosilicates) of the formula $NaMSi_xO_{2x}.yH_2O$, where M is sodium or hydrogen, x is a number from 1.9 to 4 and y is a number from 0 to 20, and preferred values for x are 2, 3 or 4, have proven to be suitable replacements for phosphate and zeolite builders. The use of such crystalline phyllosilicates for softening water is described, for example, in EP-A-0 164 514. Preferred crystalline phyllosilicates are those in which M is sodium and x assumes the values 2 or 3. Preferred replacements are both β- and δ-sodium disilicates ($Na_2Si_2O_5.yH_2O$), it being possible to obtain β-sodium disilicate, for example, by the process of PCT/WO 91/08171.

β-sodium disilicate is obtainable commercially under the name SKS 7, and δ-sodium silicate is commercially available under the name SKS 6 (commercial products from Clariant GmbH, Frankfurt). These powders generally have a bulk density below 600 g/l and have high fine particle size fractions. They usually comprise more than 30% by weight of particles with a particle size below 150 μm.

In industry, modern detergents are generally prepared by agglomerating pulverulent substances with liquid detergent ingredients to give granules. Granules are often prepared with different detergent ingredients. The granules are then mixed together to give the finished detergent. For agglomeration to be possible, the solid detergent ingredients must have a sufficiently high surfactant absorption capacity.

The absorption capacity for liquid detergent ingredients, in particular surfactants, is, however, limited in the case of the abovementioned phyllosilicates in powder form. If the absorption capacity is exceeded, the resulting product is no longer flowable and can not be used in detergents and cleaners.

SUMMARY OF THE INVENTION

The object of the present invention is therefore to provide a phyllosilicate-containing detergent and cleaner component which has a high absorption capacity for other detergent ingredients without the flow factor dropping too much, and which at the same time leads, following absorption of the detergent ingredients, to a detergent constituent which comprises, as essential constituent, phyllosilicates. The resulting detergent constituent should likewise have as high a bulk density as possible and an adequate flow factor.

This object is achieved by a phyllosilicate-containing detergent and cleaner component of the type mentioned at the beginning, which has a bulk density of less than 540 g/l, a mean particle diameter of more than 150 μm, a particle size fraction below 150 μm of less than 10%, a particle size fraction above 1180 μm of less than 5% and a flow factor of more than 15.

DESCRIPTION OF THE PREFERRED EMBODIMENTS

The mean particle diameter is preferably more than 400 μm.

The particle size fraction below 150 μm is preferably less than 5%.

The particle size fraction above 1180 μm is preferably less than 2%.

The flow factor is preferably more than 20.

The phyllosilicate-containing detergent and cleaner component preferably comprises from 50 to 98% by weight of phyllosilicate, from 2 to 50% by weight of polycarboxylate and from 0 to 20% by weight of water.

It preferably comprises from 90 to 98% by weight of phyllosilicate, from 1 to 10% by weight of polycarboxylate and from 1 to 10% by weight of water.

The invention also relates to the use of the abovementioned phyllosilicate-containing detergent and cleaner component for the preparation of detergent constituents.

The abovementioned object is also achieved by a detergent constituent comprising from 30 to 98% by weight of the phyllosilicate-containing detergent and cleaner component and from 2 to 70% by weight of detergent ingredient.

The detergent constituent preferably comprises from 50 to 95% by weight of the phyllosilicate-containing detergent and cleaner component and from 5 to 50% by weight of detergent ingredients.

The detergent ingredients are preferably anionic, cationic and/or nonionic surfactants. Customary liquid detergent ingredients can likewise be used.

The anionic surfactants are preferably used in the acidic and in the neutralized form.

The customary liquid detergent ingredients are preferably polycarboxylates, soil-release polymers, polyvinylpyrrolidone and/or silicones.

The detergent constituent preferably has a bulk density of more than 500 g/l, a mean particle diameter of more than 360 μm, a particle size fraction below 150 μm of less than 2%, a particle size fraction above 1180 μm of less than 10% and a flow factor of more than 4.

The mean particle diameter is preferably more than 500 μm.

The flow factor is preferably more than 8.

The ingredients used in detergents have different functions. The solid silicates are water-softeners. Soda and sodium bicarbonate buffer the alkalinity of the wash liquor. Surfactants, which are frequently used in liquid form, are soil-removers. Bleaching substances, such as perborate, percarbonates or organic oxygen carriers, and bleach activators or catalysts, such as tetraacetyldiamine or certain manganese complexes are stain-removers. Enzymes, such as proteases, amylases and lypases, aid soil removal. Soil-release polymers, cellulases, carboxymethyl-cellulose and polyvinylpyrrolidone protect the fibers and colors. Optical brighteners enhance the optical impression of whiteness of the laundry. Complexing agents and phosphonates complex undesired traces of heavy metals. Phosphonates and polycarboxylates are used for soil dispersal. Antifoams, perfumes and fillers round off the customary detergent formulations. Such substances and their mode of action are revealed in the known prior art.

According to the invention, the following constituents can be used.

Silicates

It is possible to use sodium phyllosilicates of the formula $Na_2Si_xO_{2x+1}.yH_2O$ in which x is a number from 1.9 to 4 and y is a number from 0 to 20. Particular preference is given to a disodium disilicate which crystallizes in the δ-phase and is obtainable from Clariant GmbH, Frankfurt under the name SKS-6. Disodium disilicates which are crystallized in the beta form are also particularly suitable.

Other phyllosilicates, such as, for example, potassium-, calcium- and magnesium-doped phyllosilicates, as cited in EP 0 630 855 and EP 0 550 048 A1, or potassium-doped phyllosilicates according to PCT/WO 96/01307 can also be used.

It is also possible to use silicon-rich sodium phyllosilicates of the formula $Na_2Si_xO_{2x+1}.yH_2O$ in which x is a number from 4 to 25 and y is a number from 0 to 20. Particular preference is given in this connection to sodium phyllosilicates in which x is approximately 8, 14 or 20 to 22 and whose crystalline structure is derived from ilerite, magadiite or kenyaite.

Surfactants

Particularly suitable surfactants are nonionic ones of the ethoxylated fatty alcohol type and alkyl polyglycosides or else anionic surfactants of the sulfonate type. Other liquid surfactants can also be used for the purposes of the invention.

Nonionic Surfactants

Nonionic surfactants used are preferably alkoxylated, advantageously ethoxylated, in particular primary alcohols having, preferably, from 8 to 18 carbon atoms and on average from 1 to 12 mol of ethylene oxide per mol of alcohol, in which the alcohol radical may be linear or branched, saturated or unsaturated, or linear and branched, saturated or unsaturated radicals may be present in the mixture, as are usually present in oxo alcohol radicals.

Alkyl Polyglycosides

Preference is given to alkyl glycosides of the formula $RO(G)_x$ in which R is a primary straight-chain or methyl-branched, in particular methyl-branched in the 2-position, aliphatic radical having from 8 to 22, preferably from 12 to 18, carbon atoms, and G is a glucose unit having 5 or 6 carbon atoms, preferably glucose. The degree of oligomerization x, which indicates the distribution of monoglycosides and oligoglycosides, is any number between 1 and 10; x is preferably from 1.2 to 1.4.

Another class of preferred nonionic surfactants, which can either be used alone as nonionic surfactant or in combination with other nonionic surfactants, in particular together with alkoxylated fatty alcohols, are alkoxylated, preferably ethoxylated or ethoxylated and propoxylated fatty acid alkyl esters, preferably having from 1 to 4 carbon atoms in the alkyl chain, in particular fatty acid methyl esters, as are described, for example, in JP 58/217598, or those prepared by the process described in PCT/WO A 90/13533.

Nonionic surfactants of the amine oxide type may also be suitable.

Glucamides

Other suitable surfactants are glucamides, i.e. polyhydroxy fatty acid amides of the formula $R_2$—CO—N($R_3$)—Z in which $R_2CO$ is an aliphatic acyl radical having from 6 to 22 carbon atoms, $R_3$ is hydrogen, an alkyl or hydroxylalkyl radical having from 1 to 4 carbon atoms, and Z is a linear or branched polyhydroxyalkyl radical having from 3 to 10 carbon atoms and from 3 to 10 hydroxyl groups.

The polyhydroxyfatty acid amides are known substances which can be obtained by reductive amination of a reducing sugar with ammonia, an alkylamine or an alkanolamine and subsequent acylation with a fatty acid, a fatty acid alkyl ester or a fatty acid chloride.

Suitable anionic surfactants of the sulfonate type are preferably $C_9$–$C_{13}$-alkylbenzenesulfonates, alpha-olefinsulfonates and alkanesulfonates. Suitable compounds are also esters of sulfo fatty acids and the disalts of alpha-sulfo fatty acids. Other suitable anionic surfactants are sulfated fatty acid glycerol esters, which are mono-, di- and triesters and mixtures thereof, as are obtained in the preparation by esterification by 1 mol of monoglycerol with from 1 to 3 mol of fatty acid or in the transesterification of triglycerides with from 0.3 to 2 mol of glycerol. Particularly suitable alkylsulfates are the sulfuric monoesters of $C_{12}$–$C_{18}$ fatty alcohols, such as lauryl, myristyl, cetyl or stearyl alcohol, and the fatty alcohol mixtures obtained from coconut oil, palm oil and palm kernel oil, which may additionally comprise contents of unsaturated alcohols, for example of oleyl alcohol.

Other suitable anionic surfactants are, in particular, soaps. Suitable compounds are saturated fatty acid soaps, such as the salts of lauric acid, myristic acid, palmitic acid, stearic acid, hydrogenated erucic acid and behenic acid, and also, in particular, the soap mixtures derived from natural fatty acids, for example coconut, palm kernel or tallow fatty acids.

The anionic surfactants can be present in the form of their sodium, potassium or ammonium salts and also as soluble salts of organic bases, such as mono-, di- or triethanolamine. The anionic surfactants are preferably in the form of their sodium or potassium salts, in particular in the form of the sodium salts. The anionic surfactants may preferably be used as free acid or as mixtures of acid and salt.

Flowability

The flowability of bulk materials can be characterized using the $ff_c$ value. The flow properties are measured in an annular shearing device. For this, a material sample is compacted in the cylindrical annular measuring chamber under the effect of a tensible force and with simultaneous rotation of the floor of the chamber relative to the roof of the chamber. To improve power transmission, baffles are attached to the floor and roof of the chamber. The tension at which the material is just sheared by the torsional movement is then determined. This is described by D. Schulze in Chem.-Ing.-Techn. 67 (1995) 60–68. The $ff_c$ value is the quotient of the compacting tension $sigma_1$ divided by the solidity of the bulk material $sigma_c$.

Accordingly, $ff_c$ values of from 2 to 4 indicate cohesive bulk materials, values of from 4 to 10 indicate moderately flowing products and values above 10 indicate free flowing products.

The significance of the flow factor for detergents For the manufacture of modern detergents in pulverulent or granular form, the raw materials themselves must have a number of advantageous properties. Both the detergent itself (corresponding to the sum of all the ingredients) and also the intermediates during manufacture must have a sufficiently high flow factor in order to ensure good handling properties during detergent manufacture and on the way to the consumer and for the consumer. Good handling properties are taken to mean, for example, the simple transportation of the material during manufacture (flowable), no clumping or adhesion during manufacture and, finally, also in the end packaging.

A particle size which is as uniform as possible and which should be as close as possible to that of the final detergent is a prerequisite for good flowability of the material. A requirement for troublefree and safe handling is that solid detergent raw materials also have a low content of particles with a very low particle diameter. Overall, flowability, characterized by the flow factor, has a considerable influence on the handling properties of the material.

EXAMPLE 1

Invention

SKS-6 powder is introduced into a Lödige plowshare mixer. With vigorous mixing, an aqueous solution of a polycarboxylate (commercial product "W74454" from Stockhausen, Krefeld) is sprayed thereon. The product is dried in a warm air drying cabinet at 110° C. This gives a phyllosilicate-containing detergent and cleaner component having an SKS-6 content of 86.6% by weight, a polycarboxylate content of 9.7% by weight and a content of water of hydration of 3.7% by weight. Other analytical data are given in Table 1.

EXAMPLE 2

Invention

A mixer (Hobart) is charged with 3.5 kg of phyllosilicate-containing detergent and cleaner component (from Example 1). 750 g of ®APG 600 UP and 750 g of ®Dehydol LT 7 are melted in a 2 l beaker with stirring at a temperature of 80° C. and metered in using a heatable dropping funnel and with slow stirring. The mixing time is 0.5 h. The resulting product is dried in a convection drying cabinet at a temperature of 110° C. The dried product is screened manually through a 1180 μm screen. The oversized fraction is ground using a Retsch mill and screened once again. The various screen fractions are mixed well with one another. The detergent constituent has an $ff_c$ value of 14.6.

EXAMPLE 3

Invention 150 kg of SKS-6 powder are placed in portions onto an electric vibrating screen (model: TMA 3070 from Siemens) having a metal screen of mesh size 1250 μm. The fraction which has passed through the screen is then screened in the same apparatus through a 250 μm screen. This gives 37 kg of a material having a particle size between 250 μm and 1250 μm. The other analytical data are given in Table 1.

EXAMPLE 4

Invention

In accordance with Example 2, 3.0 kg of coarse SKS-6 powder from Example 3 and 1.0 kg of ®APG 600 UP and 1.0 kg ®Dehydol LT 7 are used to prepare a detergent constituent. The material has an $ff_c$ value of 8. The other analytical data are given in Table 1.

EXAMPLE 5

Invention

In a Hobart mixer, a heavy-duty detergent based on the detergent constituent of Example 2 is prepared by mixing together the components given in Table 2 one after the other. The composition of the resulting detergent is given in Table 2.

In a standard household washing machine (model: W 917, Miele), special test fabrics are repeatedly (15 times) washed at 60° C. and a water hardness of 18° German hardness with this test detergent in an amount of 75 g of detergent/wash cycle. The test fabrics, which are in particular a cotton terry fabric (Vossen), one each of cotton interlock fabric and standard cotton fabric from Wäschereiforschung Krefeld Testgewebe GmbH and a standard cotton fabric from the Swiss Materials Testing Institute in St. Gallen, Switzerland, are mixed with more laundry ballast (3.75 kg). After 15 washes, a sample is taken from each of the fabrics and ashed in a muffle furnace at a temperature of 1000° C. for a period of 24 hours.

The mean ash value of the individual fabric was determined, after 15 washes, as 1.83%.

EXAMPLE 6

Invention

In a Hobart mixer, a heavy-duty detergent based on the detergent constituent of Example 4 was prepared by mixing together the components given in Table 2 one after the other. The composition of the detergent is given in Table 2. As described in Example 5, test fabrics are washed with this test detergent in a household washing machine.

The mean ash value of the individual fabric is determined, after 15 washes, as 1.97%.

EXAMPLE 7

Invention

In a manner corresponding to that of Example 1, SKS-6 powder and a polycarboxylate solution are used to prepare a phyllosilicate-containing detergent and cleaner component. The other analytical data are given in Table 1.

EXAMPLE 8

Invention

In the manner corresponding to that in Example 2, a detergent constituent is prepared in a Hobart mixer from 4 kg of phyllosilicate-containing detergent and cleaner component (from Example 7) and 1 kg of the nonionic surfactant ®Genapol OA 080. The material has an $ff_c$ value of 5.2. The other analytical data are given in Table 1.

EXAMPLE 9

Invention 500 g of a phyllosilicate-containing detergent and cleaner component (from Example 7) and 350 g of ®Marlon A375 are mixed and dried at 110° C. The material has an $ff_c$ value of 4.2. The other analytical data are given in Table 1.

EXAMPLE 10

Invention

In a manner corresponding to that of Example 2, 3.25 kg of SKS-6 from Example 3 and 1.75 kg of ®Marlon A 365 are mixed and dried at 110° C. The material has an $ff_c$ value of 5.2. The other analytical data are given in Table 1.

EXAMPLE 11

Invention

In a manner corresponding to that of Example 2, 3.25 kg of SKS-6 from Example 3 and 520 g of HLAS (96.6% by weight of active substance) are mixed and dried at 110° C. The material has an $ff_c$ value of 4.4. The other analytical data are given in Table 1.

EXAMPLE 12

Comparison 10 kg of SKS-6 powder are placed in portions onto an electric vibrating screen (model: TMA 3070 from Siemens)

having a metal screen of mesh size 500 μm. 8.15 kg of SKS-6 powder are obtained as undersized fractions. The other analytical data are given in Table 1.

EXAMPLE 13

Comparison

Following the procedure of Example 2, finely particulate SKS-6 powder from Example 7 is used to prepare an SKS-6 surfactant compound. An $ff_c$ value of 2.8 is measured, which means that this surfactant compound has significantly poorer flowability than the detergent constituent from Example 2.

TABLE 1

| | | According to the invention | | | | | | | | | Comparison | |
|---|---|---|---|---|---|---|---|---|---|---|---|---|
| Example | | 1 | 2 | 3 | 4 | 7 | 8 | 9 | 10 | 11 | 12 | 13 |
| SKS-6 | % by wt. | 86.6 | 60.62 | 100 | 60 | 71 | 57 | 52 | 65 | 65 | 100 | 70 |
| Polycarboxylate A | % by wt. | 9.7 | 6.79 | — | — | 20 | 16 | 14.6 | — | — | — | — |
| Water | % by wt. | 3.7 | 10.09 | — | — | 9 | 7 | 2.2 | — | — | — | — |
| APG | % by wt. | — | 7.5 | — | 20 | — | — | — | — | — | — | 7.5 |
| NIO I | % by wt. | — | 15 | — | 20 | — | — | — | — | — | — | 15 |
| NIO II | % by wt. | — | — | — | — | — | 20 | — | — | — | — | — |
| LAS I | % by wt. | — | — | — | — | — | — | 31.2 | — | — | — | — |
| LAS II | % by wt. | — | — | — | — | — | — | — | 35 | — | — | — |
| HLAS | % by wt. | — | — | — | — | — | — | — | — | 35 | — | — |
| Bulk density | g/l | 447 | 728 | 369 | 520 | 530 | 617 | 695 | 540 | 434 | 558 | 602 |
| d50 | μm | 447 | 552.5 | 516.2 | 649.1 | 782.8 | 820 | 740 | 855.2 | 1118 | 134 | 354.7 |
| ffc value | — | 37.4 | 14.6 | 29.4 | 8 | 59.2 | 5.2 | 3.2 | 5.2 | 4.4 | 10.9 | 2.5 |
| >1180μ | % | 0.38 | 3.55 | 0.24 | 0.81 | 2.26 | 2.4 | 14.3 | 6.3 | 43.2 | 0.54 | 4.78 |
| >1000μ | % | 4.37 | 9.74 | 2.69 | 6.27 | 13.35 | 13.7 | 25 | 19.15 | 63 | 1.32 | 6.24 |
| >710μ | % | 19.1 | 30.99 | 21.99 | 39.55 | 62.28 | 71.9 | 52.9 | 80.93 | 89.9 | 2.14 | 11.41 |
| >425μ | % | 52.55 | 65.38 | 62.18 | 88.43 | 95.16 | 100 | 81 | 99.7 | 98.8 | 5.46 | 25.71 |
| >212μ | % | 90.76 | 99.8 | — | 100 | 100 | 100 | 93.8 | 100 | 99.9 | 29.9 | 99.28 |
| >150μ | % | 96.44 | 100 | 99.08 | 100 | 100 | 100 | 96.6 | 100 | 100 | 42.2 | 99.96 |
| <150μ | % | 3.56 | 0 | 0.02 | 0 | 0 | 0 | 3.4 | 0 | 0 | 57.8 | 0.04 |

TABLE 2

| | Example 5 | Example 6 |
|---|---|---|
| Surfactant compound | 33.3 | 25 |
| (APG) | (5) | (5) |
| (NIO I) | (5) | (5) |
| SKS-6 | 20 | 25 |
| Polycarboxylate A | (2.26) | 0 |
| Polycarboxylate B | 0 | 2.26 |
| LAS III | 9 | 9 |
| Percarbonate | 20 | 20 |
| TAED | 5 | 5 |
| Enzyme | 2 | 2 |
| Antifoam | 1 | 1 |
| Sulfate | 9 | 9 |

The figures in brackets indicate the amounts of substance introduced into the detergent via the detergent constituents.

| Substances used: | |
|---|---|
| APG: | ®APG 600 UP W (ca. 50% strength solution), Henkel |
| NIO I: | ®Dehydol LT 7, Henkel |
| NIO II: | ®Genapol OA 080, Clariant |
| LAS I: | ®Marlon A 375, Hüls |
| LAS II: | ®Marlon A 365, Hüls |
| LAS III: | ®Marlon ARL, Hüls |

-continued

| Substances used: | |
|---|---|
| HLAS: | Alkylbenzenesulfonic acid |
| SKS-6: | Phyllosilicate SKS-6 powder, Clariant |
| Polycarboxylate A: | W74454 from Stockhausen |
| Polycarboxylate B: | ®Sokalan CP5, BASF |
| Percarbonate: | ®Oxyper C, Solvay Interox |
| TAED: | TAED 4049, Clariant |
| Enzyme: | ®Opticlean 375+ (Protease), Solvay |

-continued

| Substances used: | |
|---|---|
| | Enzymes |
| Antifoam: | 11.Plv.ASP3, Wacker |
| Sulfate: | Light sulfate, Solvay |

What is claimed is:

1. A phyllosilicate-containing detergent and cleaner component which has a bulk density of less than 540 g/l, a mean particle diameter of more than 150 μm, a particle size fraction below 150 μm of less than 10%, a particle size fraction above 1180 μm of less than 5% and a flow factor of more than 15, said detergent and cleaner component comprising from 50 to 98% by weight of a phyllosilicate, from 2 to 50% by weight of polycarboxylate, and from 0 to 20% of water.

2. A phyllosilicate-containing detergent and cleaner component as claimed in claim 1, wherein the mean particle diameter is more than 400 μm.

3. A phyllosilicate-containing detergent and cleaner component as claimed in claim 1, wherein the particle size fraction below 150 μm is less than 5%.

4. A phyllosilicate-containing detergent and cleaner component as claimed in claim 1, wherein the particle size fraction above 1180 μm is less than 2%.

5. A phyllosilicate-containing detergent and cleaner component as claimed in claim 1, wherein the flow factor is more than 20.

6. A phyllosilicate-containing detergent and cleaner component as claimed in claim 1, which comprises from 90 to 98% by weight of phyllosilicate, from 1 to 10% by weight of polycarboxylate and from 1 to 10% by weight of water.

7. A detergent constituent comprising from 50 to 95% by weight of the phyllosilicate-containing detergent and cleaner component of claim 1 and from 5 to 50% by weight of anionic, cationic or nonionic surfactants, including mixtures as detergent ingredients.

8. A detergent constituent as claimed in claim 7, wherein the anionic surfactants are used in the acidic and in the neutralized form.

9. A detergent constituent as claimed in claim 7 wherein said ingredient is a soil release polymer, polyvinylpyrrolidone, silicone or mixtures thereof.

10. A detergent constituent as claimed in claim 7 which hat a bulk density of more than 500 g/l, a mean particle diameter of more than 360 $\mu$m, a particle size fraction below 150 $\mu$m of less than 2%, a particle size fraction above 1180 $\mu$m of less than 10% and a flow factor of more than 4.

11. A detergent constituent as claimed in claim 7, wherein the mean particle diameter is more than 500 $\mu$m.

12. A detergent constituent as claimed in claim 7, wherein the flow factor is more than 8.

13. A detergent and cleaner component comprising 50–98% by weight of phyllosilicate which has a bulk density of less than 540 g/l, a mean particle diameter of more than 150 $\mu$m, a particle size fraction below 150 $\mu$m of less than 10%, a particle size fraction above 1180 $\mu$m of less than 5% and a flow factor of more than 15.

* * * * *